US012472413B2

(12) United States Patent
Kelley et al.

(10) Patent No.: US 12,472,413 B2
(45) Date of Patent: Nov. 18, 2025

(54) SWING TRAINING APPARATUS

(71) Applicants: Timothy Jay Kelley, Woodbury, MN (US); Gregg Curtis Ellingson, Bayport, MN (US)

(72) Inventors: Timothy Jay Kelley, Woodbury, MN (US); Gregg Curtis Ellingson, Bayport, MN (US)

(73) Assignees: Timothy Kelley, Woodbury, MN (US); Gregg Ellingson, Bayport, MN (US)

( * ) Notice: Subject to any disclaimer, the term of this patent is extended or adjusted under 35 U.S.C. 154(b) by 409 days.

(21) Appl. No.: 18/134,951

(22) Filed: Apr. 14, 2023

(65) Prior Publication Data

US 2023/0330501 A1 Oct. 19, 2023

Related U.S. Application Data

(60) Provisional application No. 63/331,350, filed on Apr. 15, 2022.

(51) Int. Cl.
*A63B 69/00* (2006.01)
*A63B 71/06* (2006.01)

(52) U.S. Cl.
CPC ..... *A63B 69/0002* (2013.01); *A63B 69/0075* (2013.01); *A63B 69/0091* (2013.01); *A63B 71/06* (2013.01); *A63B 2069/0008* (2013.01); *A63B 2071/0694* (2013.01)

(58) Field of Classification Search
CPC ..... A63B 69/0002; A63B 69/0075; A63B 69/0091; A63B 71/06; A63B 2069/0008; A63B 2071/0694
USPC ..... 473/409, 417, 422, 451, 453
See application file for complete search history.

(56) References Cited

U.S. PATENT DOCUMENTS

| | | | |
|---|---|---|---|
| 4,451,036 | A | 5/1984 | Sinclair et al. |
| 4,456,250 | A | 6/1984 | Perrone, Jr. |
| 4,796,885 | A | 1/1989 | Wright |
| 4,886,267 | A | 12/1989 | Licciardi et al. |
| 5,087,039 | A | 2/1992 | Laseke |

(Continued)

OTHER PUBLICATIONS hitoffinfinitee.com [online], "Infinitee is now part of the Tanner Tees!" retrieved on Apr. 11, 2023, retrieved from URL<hitoffinfinitee.com>, believed to be available as early as Aug. 2022; 1 page.

*Primary Examiner* — Nini F Legesse
(74) *Attorney, Agent, or Firm* — Mueting Raasch Group

(57) ABSTRACT

Various embodiments of a swing training apparatus are disclosed. The apparatus includes an adjustable base assembly having an adaptor adapted to connect the adjustable base assembly to a support and a rotating carrier connected to the support, a ball arm assembly connected to the support, and a casting indicator assembly connected to the rotating carrier. The casting indicator assembly includes a casting arm and a casting indicator connected to the casting arm proximate a second end of the casting arm. The casting indicator extends away from the casting arm along a casting indicator axis. The casting indicator includes bat contact indicators that extend away from an indicator base. Further, the indicator base is aligned with the casting indicator axis. Rotation of the rotating carrier relative to the adjustable base assembly causes corresponding rotation of the casting indicator assembly.

20 Claims, 8 Drawing Sheets

(56) References Cited

U.S. PATENT DOCUMENTS 5,156,402 A * 10/1992 Hart ..... A63B 69/0024 482/109
5,595,384 A 1/1997 Hardison, Jr.
5,916,045 A 6/1999 Busch
6,099,418 A 8/2000 Owen
6,413,175 B1 7/2002 Mooney, Jr.
6,435,990 B1 8/2002 Bradley
6,461,255 B1 10/2002 Smith
6,551,204 B1 4/2003 Di Re
6,579,195 B2 6/2003 Lamb
6,878,077 B2 4/2005 Andrews
7,169,067 B2 1/2007 Town
7,182,705 B2 2/2007 Lin
7,214,147 B2 5/2007 Gutierrez
7,335,117 B2 2/2008 Reason-Kerkhoff
D563,496 S 3/2008 Hawkins
7,354,360 B1 4/2008 Eckstein
7,517,290 B1 * 4/2009 Springer ..... A63B 69/0002 473/428
7,641,573 B2 1/2010 Cech
7,674,194 B2 3/2010 Lortscher
7,775,914 B1 8/2010 Greene
8,257,202 B1 9/2012 Stanek
8,303,439 B2 11/2012 Spallina
8,414,429 B2 4/2013 Belt
8,535,178 B2 9/2013 Keller et al.
8,556,753 B1 10/2013 Dixon, Jr.
8,568,254 B2 10/2013 Keller
8,597,143 B2 12/2013 Newman
8,602,920 B2 12/2013 Windsor
8,734,274 B1 5/2014 Hochberg
8,747,258 B2 6/2014 Durham et al.
8,784,239 B2 7/2014 Harvey et al.
8,852,032 B1 * 10/2014 Barnes ..... A63B 21/4035 473/453
8,858,369 B2 10/2014 Murphy
8,992,348 B2 3/2015 Meier et al.
9,050,516 B2 6/2015 Holland et al.
9,272,195 B2 3/2016 Argiro et al.
9,327,175 B2 5/2016 Pressley
9,339,709 B2 * 5/2016 Lagier ..... A63B 69/0002
9,358,440 B1 6/2016 Burrell
9,375,622 B2 6/2016 Bond
9,381,416 B2 7/2016 Stojanovic
9,724,582 B2 8/2017 Burrell
9,814,958 B1 11/2017 Orenstein et al.
10,058,756 B1 8/2018 Basilone
10,406,419 B1 9/2019 Dickerson
10,639,533 B2 5/2020 LoDuca et al.
10,874,924 B2 12/2020 Walton
11,311,786 B1 * 4/2022 Willardson ..... A63B 71/023
2015/0105187 A1 * 4/2015 Willardson ..... A63B 69/0002 473/417
2017/0065865 A1 * 3/2017 Beedle ..... A63B 69/0075
2020/0316450 A1 10/2020 Hunt et al.

* cited by examiner

SWING TRAINING APPARATUS

This application claims the benefit of U.S. Provisional Application No. 63/331,350, filed Apr. 15, 2022, the disclosure of which is incorporated by reference herein in its entirety.

SUMMARY

In general, the present disclosure provides various embodiments of a swing training apparatus and a system that includes such apparatus. The swing training apparatus includes an adjustable base assembly, a ball arm assembly connected to the support, and a casting indicator assembly that is connected to a rotating carrier. The casting indicator assembly includes a casting arm and a casting indicator connected to the casting arm. The casting arm can at least in part define a selected swing path for a baseball or softball batter from a batter's initial batting position and through contact with a ball placed on a cradle of the ball arm assembly. In one or more embodiments, the swing training apparatus can also include a swing trajectory guide that can be connected to a ball arm of the ball arm assembly. The swing trajectory guide can be adapted to define a selected attack angle that is formed between a guide axis of the swing trajectory guide and a horizontal plane that is substantially parallel to a ground surface upon which the apparatus is disposed.

In one aspect, the present disclosure provides a swing training apparatus that includes an adjustable base assembly having a first major surface adapted to be disposed on a ground surface, a second major surface opposed to the first major surface, and a base axis that is substantially orthogonal to the first major surface. The adjustable base assembly further includes an adaptor adapted to connect the adjustable base assembly to a support and a rotating carrier connected to the support. The rotating carrier is adapted to rotate relative to the adjustable base assembly about a central axis passing through the adaptor and support, where the central axis is substantially parallel to the base axis. The apparatus further includes a ball arm assembly connected to the support and having a ball arm and a ball cradle, the ball arm extending along a ball arm axis between a base end of the ball arm and a cradle end of the ball arm, where the base end is connected to the support and the cradle end is distal from the support, and further where the ball cradle is connected to the ball arm at the cradle end of the ball arm. The assembly further includes a casting indicator assembly connected to the rotating carrier. The casting indicator assembly includes a casting arm that extends between a first end and a second end along a casting arm axis, the first end located proximate the rotating carrier and the second end distal from the rotating carrier; and a casting indicator connected to the casting arm proximate the second end of the casting arm. The casting indicator extends away from the casting arm along a casting indicator axis. The casting indicator includes a flexible member extending away from an indicator base, where the indicator base is aligned with the casting indicator axis. Rotation of the rotating carrier relative to the adjustable base assembly causes corresponding rotation of the casting indicator assembly.

In another aspect, the present disclosure provides a swing training apparatus system that includes a swing training apparatus and a container adapted to receive the swing training apparatus. The swing training apparatus includes an adjustable base assembly having a first major surface adapted to be disposed on a ground surface, a second major surface opposed to the first major surface, and a base axis that is substantially orthogonal to the first major surface. The adjustable base assembly further includes an adaptor adapted to connect the adjustable base assembly to a support and a rotating carrier connected to the support. The rotating carrier is adapted to rotate relative to the adjustable base assembly about a central axis passing through the adaptor and support, where the central axis is substantially parallel to the base axis. The apparatus further includes a ball arm assembly connected to the support and having a ball arm and a ball cradle, the ball arm extending along a ball arm axis between a base end of the ball arm and a cradle end of the ball arm, where the base end is connected to the support and the cradle end is distal from the support, and further where the ball cradle is connected to the ball arm at the cradle end of the ball arm. The assembly further includes a casting indicator assembly connected to the rotating carrier. The casting indicator assembly includes a casting arm that extends between a first end and a second end along a casting arm axis, the first end located proximate the rotating carrier and the second end distal from the rotating carrier; and a casting indicator connected to the casting arm proximate the second end of the casting arm. The casting indicator extends away from the casting arm along a casting indicator axis. The casting indicator includes a flexible member extending away from an indicator base, where the indicator base is aligned with the casting indicator axis. Rotation of the rotating carrier relative to the adjustable base assembly causes corresponding rotation of the casting indicator assembly.

In another aspect, the present disclosure provides a method that includes connecting an adaptor to an adjustable base assembly, where the adjustable base assembly includes a first major surface adapted to be disposed on a ground surface, a second major surface opposed to the first major surface, and a base axis that is substantially orthogonal to the first major surface; connecting a support to the adaptor; and connecting a rotating carrier to the support, where the rotating carrier is adapted to rotate relative to the adjustable base assembly about a central axis passing through the adaptor and support, and where the central axis is substantially parallel to the base axis. The method further includes connecting a casting indicator assembly to the rotating carrier, where the casting indicator assembly comprises a casting arm and a casting indicator connected to the casting arm; and connecting a ball arm assembly to the support. The ball arm assembly includes a ball arm and a ball cradle connected to the ball arm, where the ball arm extends along a ball arm axis between a base end of the ball arm and a cradle end of the ball arm. The base end is connected to the support and the cradle end is distal from the support, and the ball cradle is connected to the ball arm at the cradle end of the ball arm.

All headings provided herein are for the convenience of the reader and should not be used to limit the meaning of any text that follows the heading, unless so specified.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
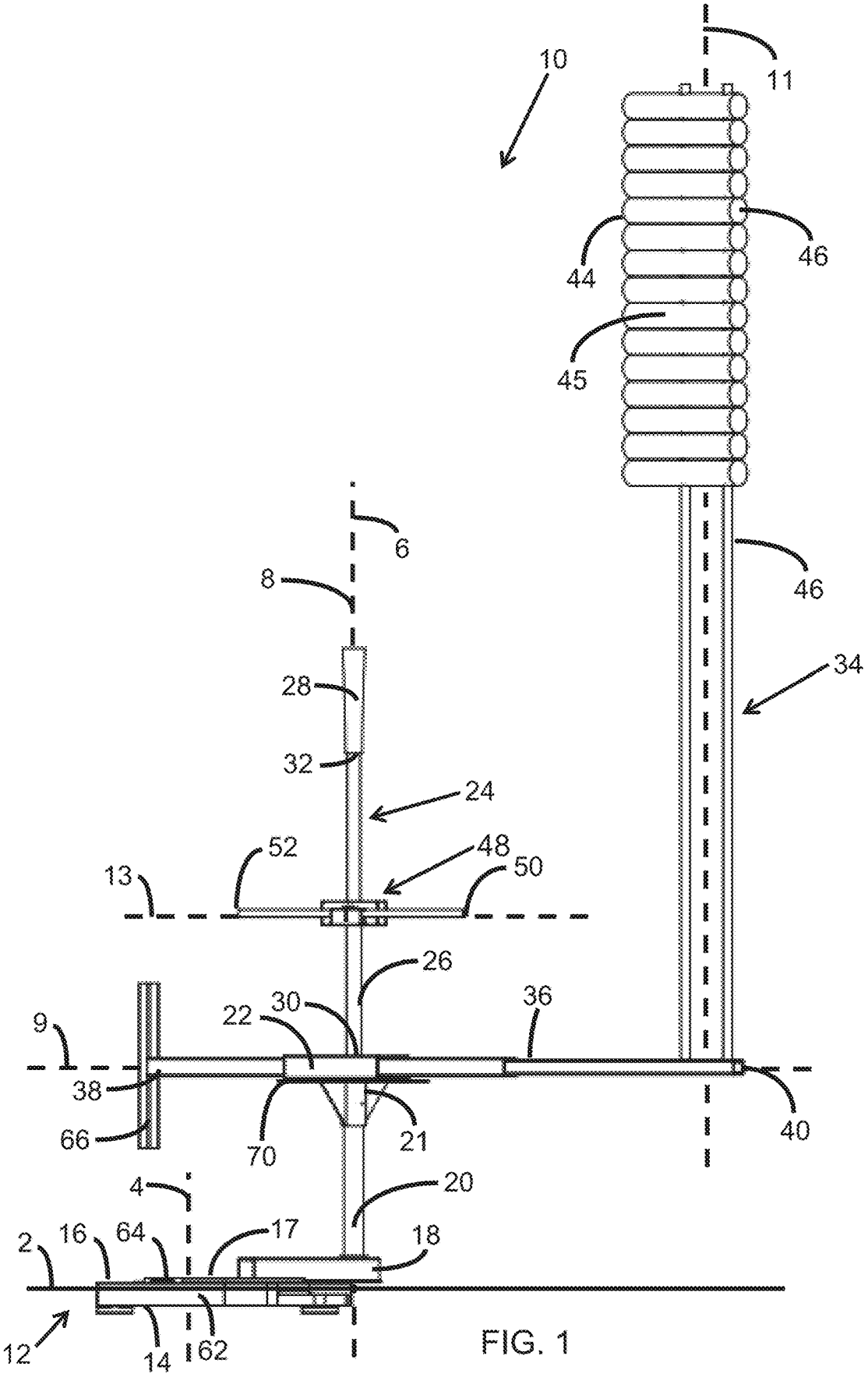
FIG. 1 is a schematic plan view of one embodiment of a swing training apparatus.

In general, the present disclosure provides various embodiments of a swing training apparatus and a system that includes such apparatus. The swing training apparatus includes an adjustable base assembly, a ball arm assembly and rotating carrier connected to the support, and a casting indicator assembly that is connected to a rotating carrier. The casting indicator assembly includes a casting arm and a casting indicator connected to the casting arm. The casting arm can at least in part define a selected swing path for a baseball or softball batter from a batter's initial batting position and through contact with a ball placed on a cradle of the ball arm assembly. In one or more embodiments, the swing training apparatus can also include a swing trajectory guide that can be connected to a ball arm of the ball arm assembly. The swing trajectory guide can be adapted to define a selected attack angle that is formed between a guide axis of the swing trajectory guide and a horizontal plane that is substantially parallel to a ground surface upon which the apparatus is disposed.

A batting tee can be utilized by baseball and softball players as a training tool to develop various mechanics of a swing. A common type of batting tee includes a base that rests on a ground surface and a support that extends vertically from the base. A ball arm can be connected to an end of the support that is distal from the base. The ball arm includes a cradle that is adapted to hold a baseball or softball. A length of the support can be manipulated to place the ball at selected heights relative to the ground surface in a vertical plane that outlines the strike zone. The batting tee and ball can be physically moved from one location to another to position the ball at different locations in a horizontal plane that outlines the strike zone. Another solution for the batter to contact the ball at different horizontal locations in the strike zone is to have the batter move relative to the batting tee and ball.

Such batting tees do not, however, provide to the batter any feedback or guidance regarding a desired swing path. In general, a swing path is defined as a path of a barrel of a bat from the batter's initial position at the beginning of the swing to a final position of the batter's swing. Such a path can be defined in two orthogonal planes: a horizontal plane that is substantially parallel to the ground surface, and a vertical plane that is substantially orthogonal to the horizontal plane. The optimal swing path has the bat path aligned with the trajectory of the ball path or pitch as long as possible. The shortest swing path to the ball also provides the batter with the longest time to react to the location and type of pitch thrown. An inside out swing where the batter keeps their hands close to their torso and the knob end of the bat inside the ball allows for the shortest swing path. An outside in swing, also referred to as "casting," is where the knob end of the bat is outside of the ball for the majority of the swing until contact is made with the ball. The optimal swing aligns the bat path with the ball path or pitch for as long as possible, and the swing is as short as possible to allow the batter the maximum amount of time to react to the pitch type and location to get the barrel of the bat or "sweet spot" positioned to contact the ball.

A typical batting tee cannot provide any feedback to the batter that they are casting their hands and the bat. Another prominent mechanical issue found in lesser experienced batters is a negative attack angle. An attack angle is defined by the bat's path at impact relative to a horizontal plane that is parallel to a ground surface. A negative attack angle can cause the bat to either direct the ball into the ground or impart backspin to the ball. While a certain amount of backspin can cause the ball to travel further, too much backspin can create pop flies, which are typically caught by fielders. Oftentimes, current professional players prefer a positive attack angle that follows the trajectory of the ball or pitch from the pitcher to home plate. Such a positive attack angle typically produces a positive launch angle of the ball. Launch angle is defined as the angle formed by the path of the ball following impact of the bat with the ball and a horizontal plane that is parallel to a ground surface. Once again, a typical batting tee is not capable of providing much if any feedback or guidance regarding a desired or selected attack angle or launch angle.

One or more embodiments of a swing training apparatus described herein can provide various advantages over currently existing batting tees. For example, the swing training apparatus can include an adjustable base assembly that allows the ball to be positioned in the horizontal strike zone by rotating a plate and extending an adaptor that's connected to a support and ball arm assembly that has a ball cradle that supports a ball. The swing training apparatus can also include a casting indicator assembly that can provide feedback to a batter as to whether the batter is casting his or her hands and the bat. Such a casting indicator assembly can be disposed in any suitable position relative to a ball placed on a cradle of the apparatus. Further, for example, the swing training apparatus can include a swing trajectory guide that can be adapted to provide feedback to the batter for a selected attack angle of the ball disposed on the cradle. In addition, the swing trajectory guide can also be rotated to align with a preferred ball path that a hitter should orthogonally align their bat with to place the ball in the field.

Figure 2:
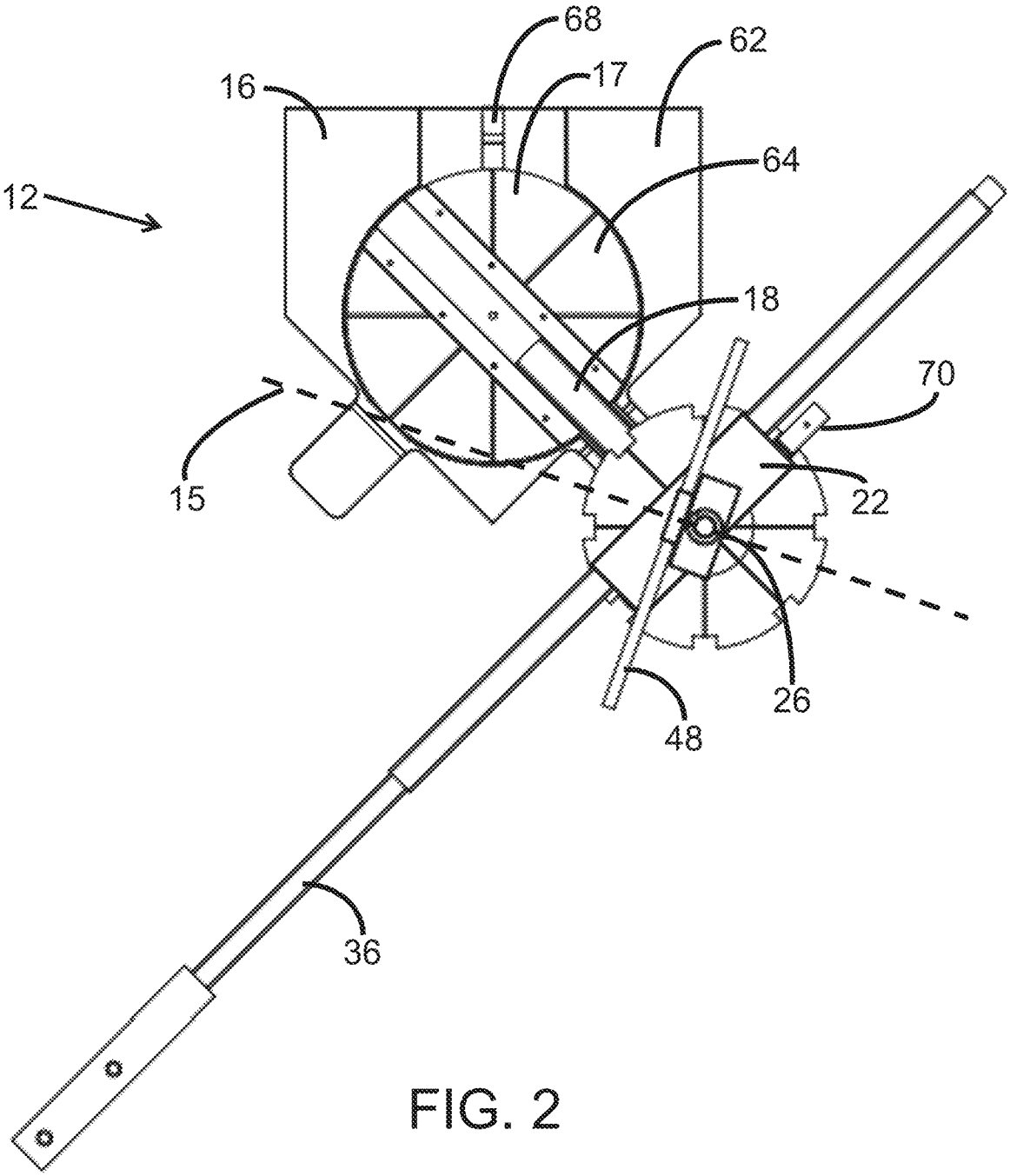
FIG. 2 is a schematic top plan view of the swing training apparatus of FIG. 1.
Figure 3:
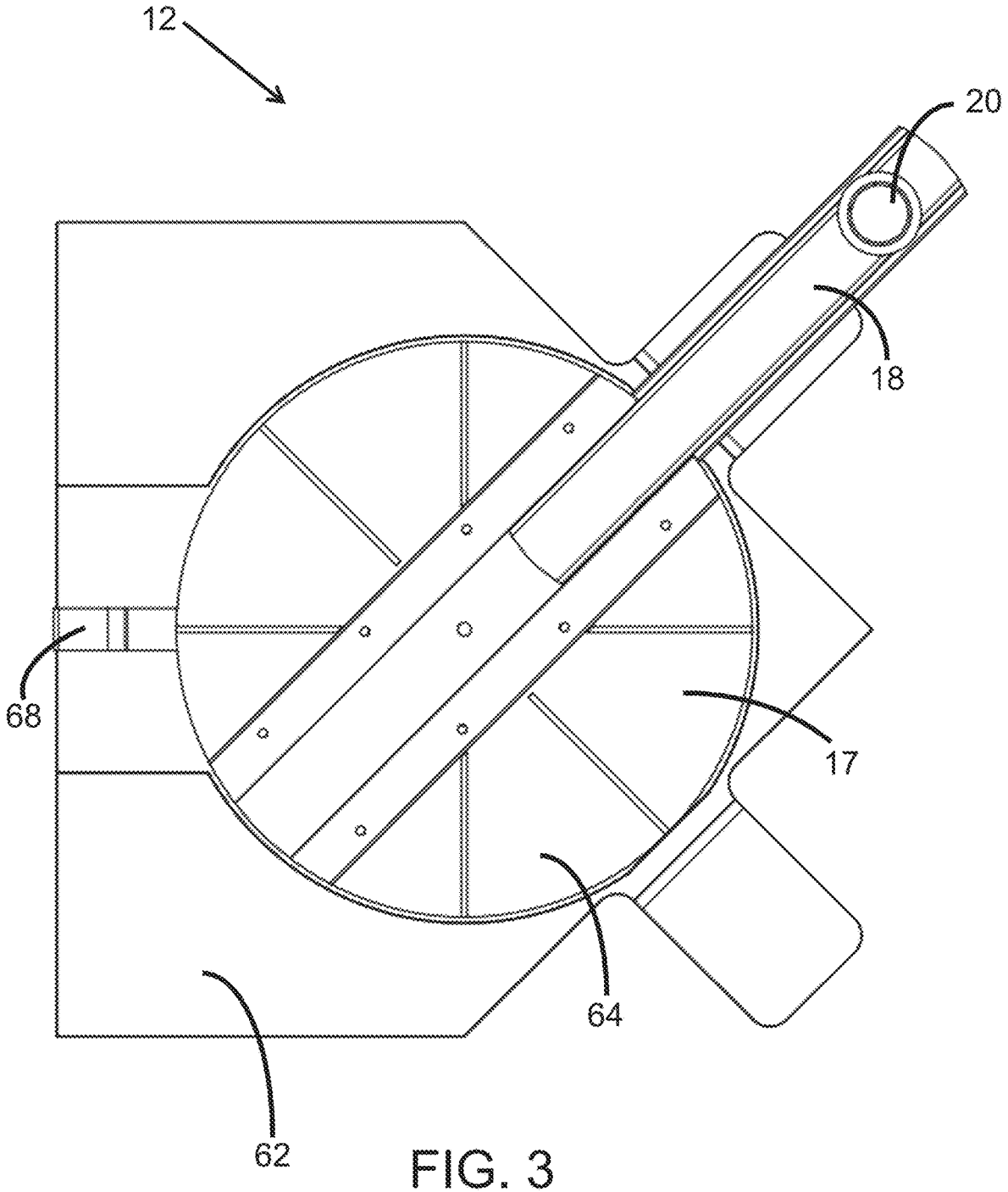
FIG. 3 is a schematic cross-section top plan view of a portion of the swing training apparatus of FIG. 1 below the rotating carrier.

FIGS. 1-8 are various views of one embodiment of a swing training apparatus 10. The apparatus 10 includes an adjustable base assembly 12 that has a first major surface 14 adapted to be disposed on a ground surface 2 (FIG. 1), a second major surface 16 opposed to the first major surface, and a base axis 4 that is substantially orthogonal to the first major surface. The adjustable base assembly 12 further includes a base plate 62 that includes a first major surface and a second major surface, where the first major surface of the base plate defines the first major surface 14 of the adjustable base assembly. The base assembly 12 further includes a rotating plate 64 that is rotatably connected to the base plate 62. The rotating plate 64 is adapted to rotate about a base axis 4 relative to the base plate 62. The base plate includes a detent mechanism 68 that fixes the rotating plate at set angles relative to the base plate as shown in FIG. 3. The rotating plate includes a first major surface that faces the second major surface of the base plate 62 and a second major surface that defines the second major surface 17 of the base assembly 12.

Figure 4:
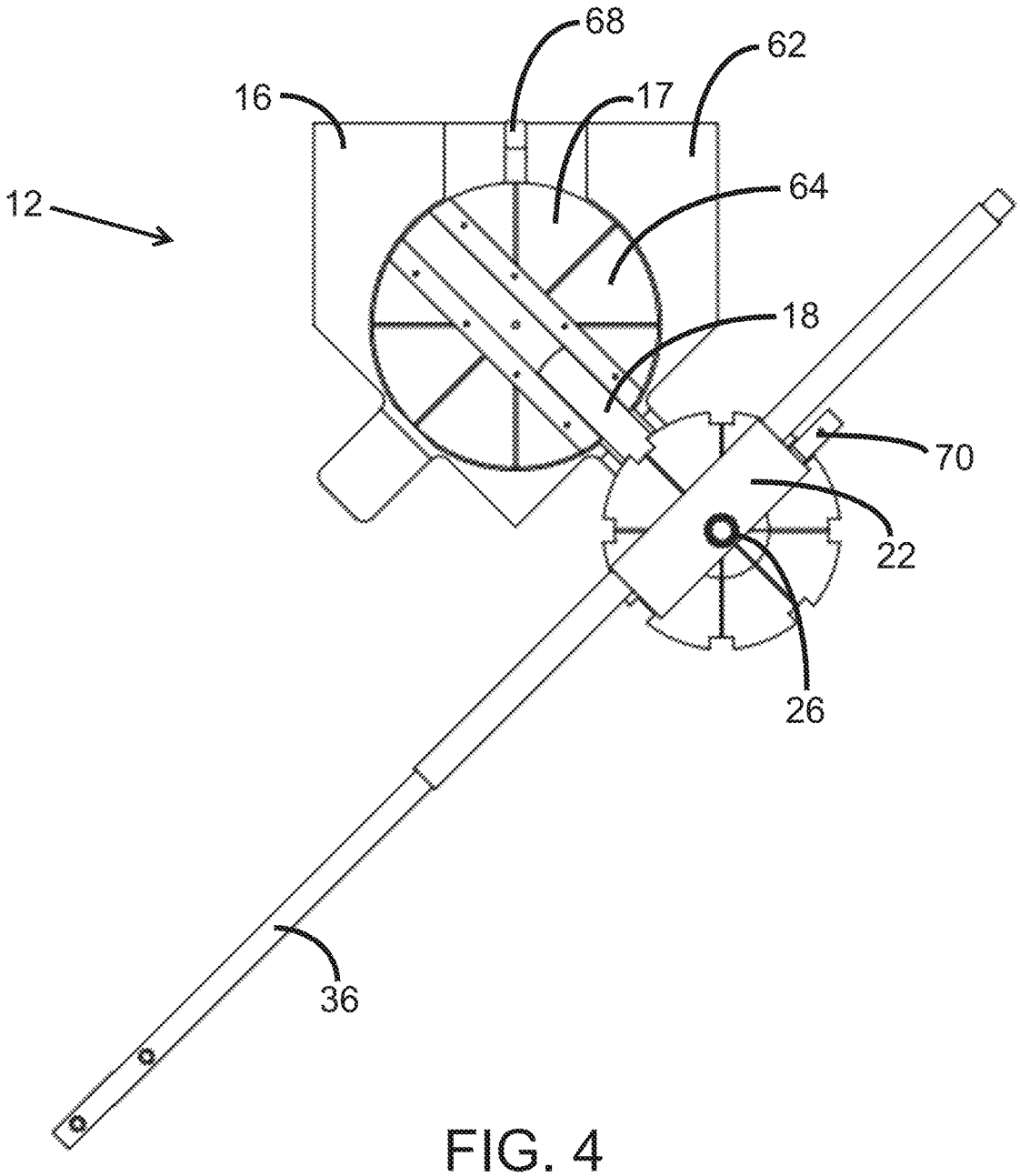
FIG. 4 is a schematic cross-section top plan view of a portion of the swing training apparatus of FIG. 1 below the trajectory guide.
Figure 5:
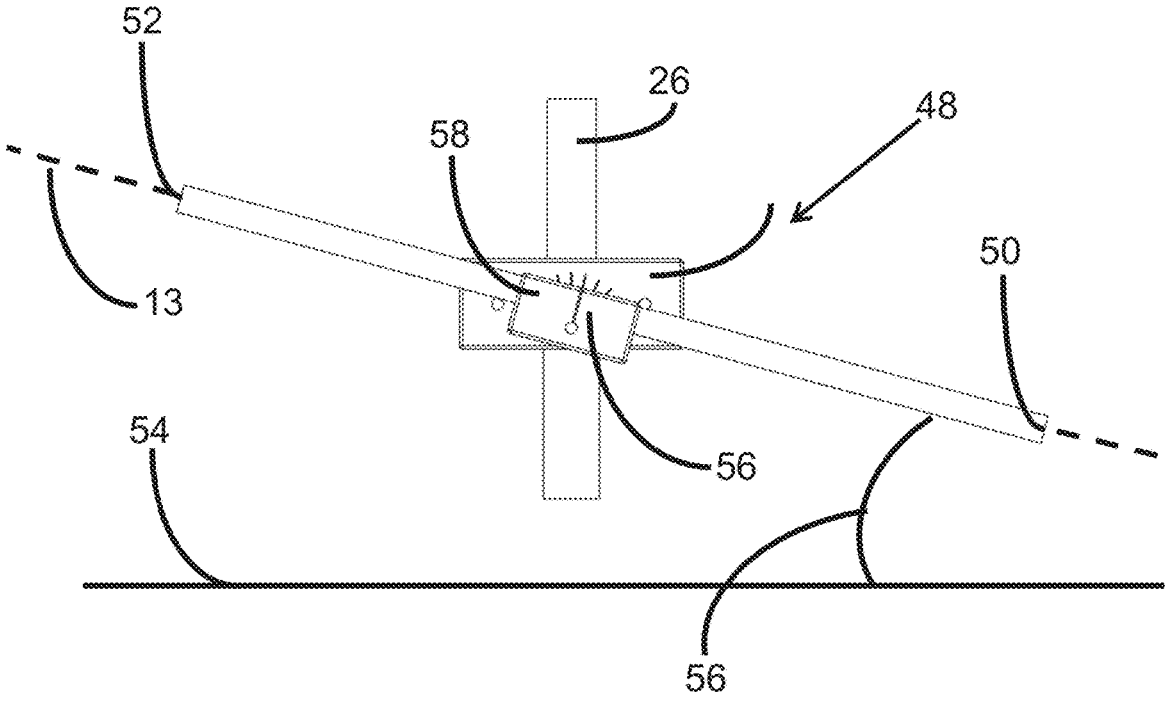
FIG. 5 is a schematic plan view of a portion of the swing training apparatus of FIG. 1 that includes a swing trajectory guide of the apparatus.
Figure 6:
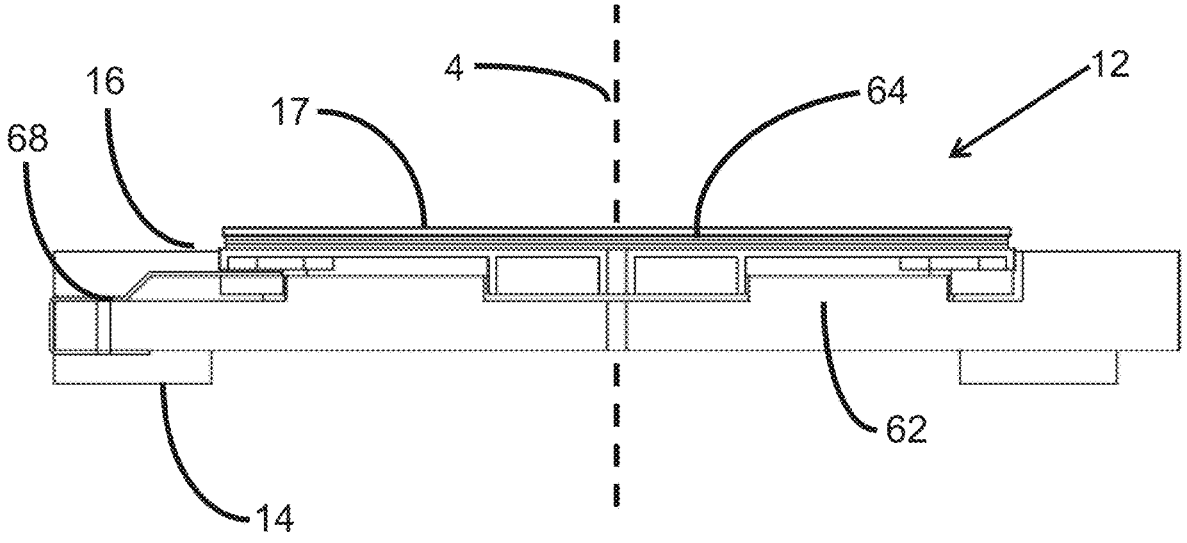
FIG. 6 is a schematic cross-section view of an adjustable base assembly of the swing training apparatus of FIG. 1.
Figure 7:
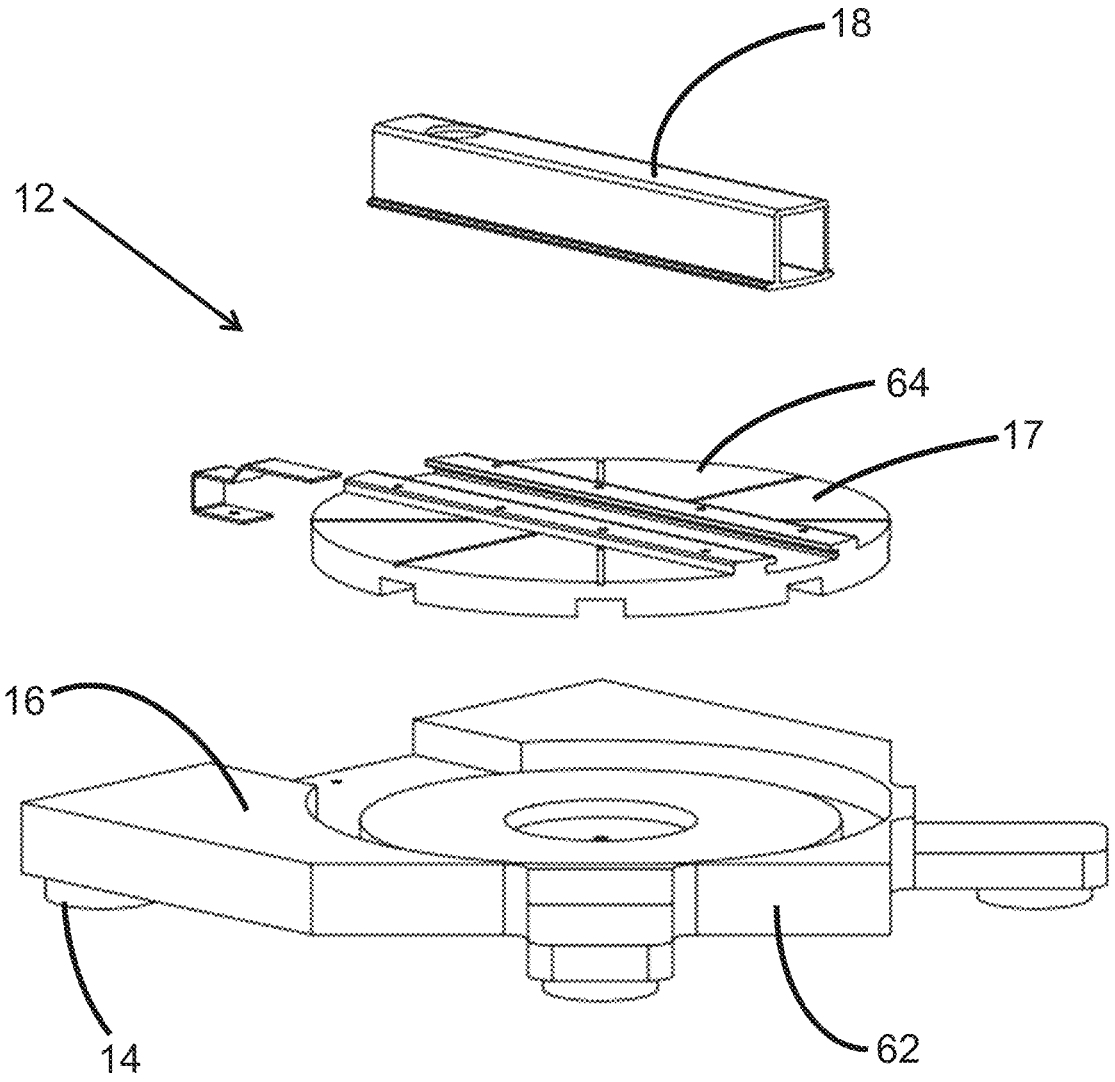
FIG. 7 is an exploded view of the adjustable base assembly of FIG. 6.
Figure 8:
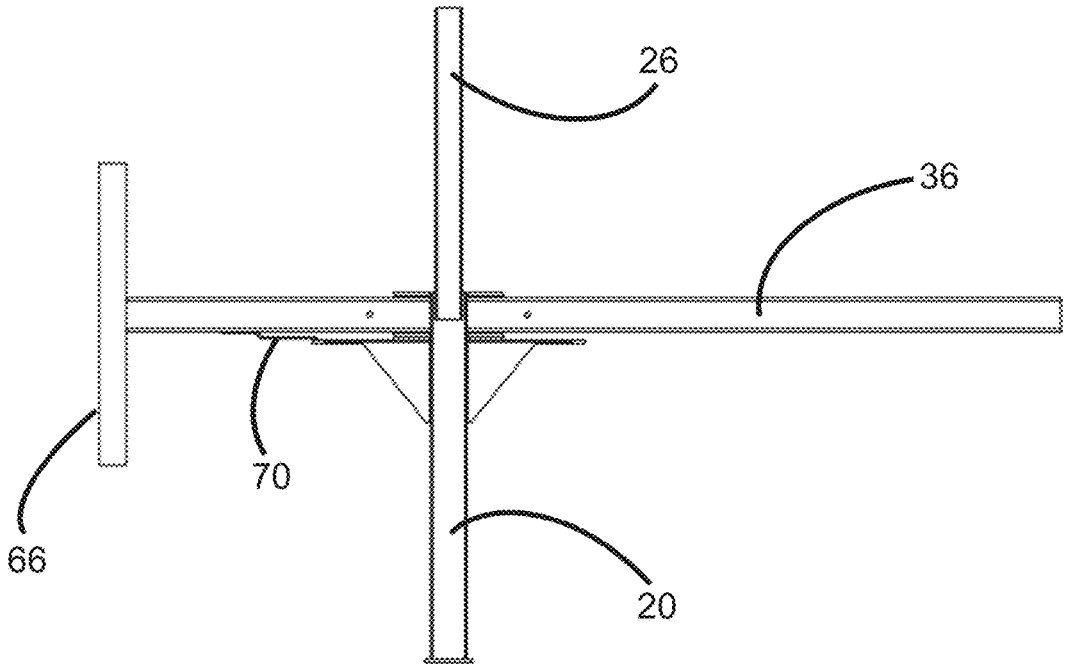
FIG. 8 is a schematic cross-section view of a portion of the swing training apparatus of FIG. 1.

The adjustable base assembly 12 also includes an adaptor 18 that is adapted to connect the adjustable base assembly to a support 20 and a rotating carrier 22 connected to the support. In one or more embodiments, the adaptor 18 is rotatably connected to the adjustable base assembly 12 (e.g., to the rotating plate 64). In one or more embodiments, the adaptor 18 is slidably connected to the rotating plate 64 of adjustable base assembly 12. The adaptor 18 is adapted to connect the adjustable base assembly to a support 20 and a rotating carrier 22 is also connected to the support. The rotating carrier 22 is adapted to rotate relative to the adjustable base assembly 12 about a central axis 6 passing through the adaptor 18 and support 20, where the central axis is substantially parallel to the base axis 4. The rotating carrier includes a detent mechanism 70 that releasably fixes the rotating carrier at set angles as shown in FIG. 4. In one or more embodiments, the adaptor 18 can be rotated above the base axis 4 such that the support 20, the ball arm assembly 24, the rotating carrier 22, and the casting indicator assembly 34 are disposed in a desired orientation relative to the adjustable base assembly 12.

The apparatus 10 further includes a ball arm assembly 24 connected to the support 20, where the ball arm assembly includes a ball arm 26 and a ball cradle 28. The ball arm 26 extends along a ball arm axis 8 between a base end 30 of the ball arm and a cradle end 32 of the ball arm, where the base end is connected to the support 20 and the cradle end is distal from the support. In one or more embodiments, the ball arm 26 is telescopingly received by the support 20. Further, the ball cradle 28 is connected to the ball arm 26 at the cradle end 32 of the ball arm. In one or more embodiments, a distance between a top edge of the ball cradle 28 and the support 20 is adjustable. In one or more embodiments, the height of the top edge of the ball cradle 28 relative to the adaptor 18 can be adjusted by increasing or decreasing a length of the ball arm 26 along the central axis 6.

In addition, the apparatus 10 includes a casting indicator assembly 34 connected to the rotating carrier 22. The casting indicator assembly 34 includes a casting arm 36 that extends between a first end 38 and a second end 40 along a casting arm axis 9. The first end 38 is located proximate the rotating carrier 22 and the second end 40 is distal from the rotating carrier. The casting indicator assembly 34 further includes a counterweight 66 connected to the casting arm 36 proximate the first end 38 and a casting indicator 42 connected to the casting arm 36 proximate the second end 40 of the casting arm. The casting indicator 42 extends away from the casting arm 36 along a casting indicator axis 11. In one or more embodiments, the rotating carrier 22 can be rotated about the central axis 6 such that the casting arm 36 and the casting indicator 42 are disposed in a desired orientation relative to a desired swing path. The casting indicator 42 includes one or more bat contact indicators 44, which may, in one or more embodiments include a flexible member 45 that extend away from an indicator base 46. The indicator base 46 is aligned with the casting indicator axis 11. In one or more embodiments, rotation of the rotating carrier 22 relative to the central axis 6 causes corresponding rotation of the casting indicator assembly 34.

The casting indicator assembly 34 can be adapted to indicate to a batter that the hands and bat are being cast towards a ball disposed on the ball cradle 28. Such casting can cause the bat path to be elongated, thereby increasing the time between initiation of the swing by the batter and contact with the ball. Further, such casting can increase the probability that the ball will not impact the bat within a sweet spot of the bat, where a restoration force of the bat is at its maximum range of values.

In general, the casting indicator assembly 34 can take any suitable shape and have any suitable dimensions. Further, the casting arm 36 of the casting indicator assembly 34 can include any suitable materials, e.g., at least one of a metallic, polymeric, or other material. In one or more embodiments, the casting arm 36 can include a composite material such as carbon composite or ceramic composite material. Further, the casting arm 36 of the casting indicator assembly 34 can be slidably connected to the rotating carrier 22 such that a distance between the casting indicator axis 11 and the central axis 6 as measured in a direction orthogonal to the casting indicator axis and the central axis is adjustable. Such adjustability of the casting arm 36 allows the casting indicator 42 to be disposed in a desired position for a particular batter. In one or more embodiments, the casting indicator assembly 34 is removably connected to the rotating carrier 22. In one or more embodiments, the casting arm 36 can include a plurality of casting arms that are different dimensions so as to be telescopingly received by each other such that the casting arm has an adjustable length.

Further, the casting indicator 42 can include any suitable materials, e.g., at least one of a metallic, polymeric, or other material. The casting indicator 42 can also take any suitable shape and have any suitable dimensions. The casting indicator 42 can have any suitable length along the casting indicator axis 11. In one or more embodiments, the casting indicator 42 can have an adjustable length along the casting indicator axis 11 and be removably connected to the casting arm 36.

Further, the bat contact indicators 44 can include any suitable materials, e.g., a resilient material such as foam, fabric, rubber, or other material. In one or more embodiments, the bat contact indicators 44 can be adapted to provide feedback to the batter when the bat makes contact with one or more of the bat contact indicators. Such feedback can indicate to the batter that the hands and the bat have been casted and have, therefore, been extended beyond a desired bat path from the starting position of the bat to the ball on the cradle 28. The feedback provided by the bat contact indicators 44 can be any suitable type of tactile feedback, e.g., visible, sound feedback.

The casting indicator assembly 34 can include any suitable number of bat contact indicators 44. In one or more embodiments, one or more of the bat contact indicators 44 can include a flexible member 45 with each member extending from the indicator base 46. Further, in one or more embodiments, each member of the plurality of flexible members 45 extends in a direction substantially orthogonal to the casting indicator axis 11. In one or more embodiments, the bat contact indicators 44 can be a unitary flexible member. In one or more embodiments, each bat contact indicator 44 can have any suitable length along the casting indicator axis 11.

Figure 10:
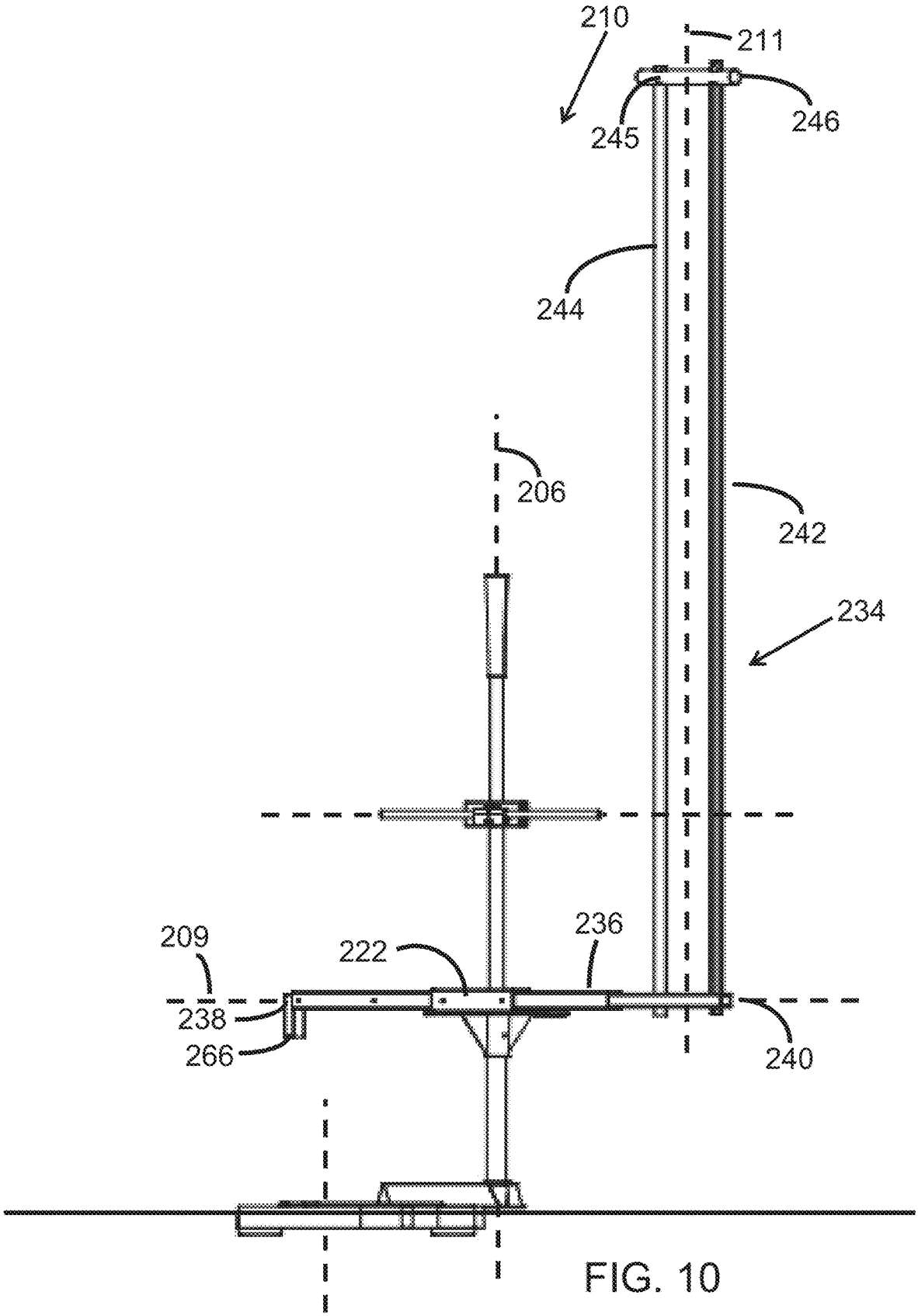
FIG. 10 is a schematic plan view of another embodiment of a swing training apparatus.

FIG. 10 is a schematic perspective view of another embodiment of a swing training apparatus 210. All design considerations and possibilities described herein regarding the swing training apparatus 10 of FIGS. 1-8 apply equally to the swing training apparatus 210 of FIG. 10. The apparatus 210 includes a casting indicator assembly 234. The casting indicator assembly 234 can be utilized with any suitable swing training apparatus, e.g., swing training apparatus 10 of FIG. 1. The assembly 234 includes a casting arm 236 that extends between a first end 238 and a second end 240 along a casting arm axis 209. The first end 238 is located proximate a rotating carrier 222 of the apparatus 210 and the second end 240 is distal from the rotating carrier. The casting indicator assembly 234 further includes a counterweight 266 connected to the casting arm 236 proximate the first end 238 and a casting indicator 242 connected to the casting arm 236 proximate the second end 240 of the casting arm. The casting indicator 242 extends away from the casting arm 236 along a casting indicator axis 211. In one or more embodiments, the rotating carrier 222 can be rotated about a central axis 206 such that the casting arm 236 and the casting indicator 242 are disposed in a desired orientation relative to a desired swing path. The casting indicator 242 includes a bat contact indicator 244, which may, in one or more embodiments include a brace 245 that is connected to an indicator base 246. The indicator base 246 can be aligned with the casting indicator axis 211. Further, the bat contact indicator 244 extends in a direction substantially orthogonal to the end of the brace 245 and parallel to the casting indicator axis 211. In one or more embodiments, the bat contact indicator 244 can be a unitary flexible member or fabric. The bat contact indicator 244 can include any suitable material, e.g., the same materials described herein regarding bat contact indicator 44 of FIG. 1.

In one or more embodiments, the bat contact indicator 244 can extend in a direction orthogonal to the brace 245 any suitable distance. In one or more embodiments, the bat contact indicator 244 can be pivotably attached to an end of the brace 245 and releasably attached to a slot in the casting arm 236. In one or more embodiments, the bat contact indicator 244 can be adapted to indicate to the batter that the bat and hands are being cast towards the ball disposed on the ball cradle 228. In one or more embodiments, the bat contact indicator 244 can be adapted to be partially or completely disconnected from at least one of the brace 245 or the casting arm 236 upon contact with the bat, thereby indicating that the bat is on an undesirable path to the ball. The bat contact indicator 244 can then be reattached to the brace 245 and casting arm 236 using any suitable technique.

Returning to FIG. 1, the casting indicator assembly 34 can provide other types of feedback to the batter regarding the bat path of the bat. For example, in one or more embodiments, the casting indicator assembly 34 can include a sensor disposed in any suitable location relative to the casting arm 36. The sensor can be adapted to detect a position of the bat. In one or more embodiments, the sensor can be adapted to indicate that the bat has been cast. Any suitable sensor can be utilized with the casting assembly, e.g., optical, magnetic, etc. Any suitable optical sensor can be utilized, e.g., a photoelectric sensor, a laser with or without a reflector, etc. In one or more embodiments, the casting indicator assembly 34 can include the casting indicator 42 and a sensor. In one or more embodiments, the sensor can replace the casting indicator 42. Further, the sensor can be operatively connected to a light or sound indicator that can provide feedback to the batter, e.g., a flashing or coloring changing light, a speaker that produces audible feedback, etc.

In one or more embodiments, the swing training apparatus 10 can also include a swing trajectory guide 48 connected to the ball arm. The swing trajectory guide 48 extends between a rear end 50 and a forward end 52 along a guide axis 13. In one or more embodiments, the swing trajectory guide 48 is rotatably connected to the ball arm 26 such that the swing trajectory guide is adapted to rotate about the ball arm axis 8. Further, in one or more embodiments, the swing trajectory guide 48 is further adapted to rotate about an attack angle axis 15 that is substantially orthogonal to the ball arm axis 8 (as shown in FIG. 2) such that an attack angle 56 formed between the guide axis 13 and a horizontal plane 54 that is substantially parallel to the ground surface 2 can be selected as is shown in FIG. 3. The attack angle 56 can include any suitable angle, e.g., no greater than ±90 degrees. The swing trajectory guide 48 can also include an attack angle indicator 58 that includes indicia 60 that indicates a selected attack angle 56.

In one or more embodiments, the swing trajectory guide 48 can further include one or more sensors that can be adapted to detect a launch angle of the ball disposed on the cradle 28 following contact with the bat. The one or more sensors can include any suitable sensor, e.g., the same sensor described herein regarding the sensor of the casting indicator assembly 34. The swing trajectory guide 48 can also include a display or audio device such as a speaker that can provide feedback to the batter regarding the attack angle of the swing. In one or more embodiments, such attack angle feedback can include a predicted distance of ball flight based upon the bat swing attack angle and the ball launch angle after contact and other factors, e.g., exit velocity of the ball upon impact with the bat. The one or more sensors of the swing trajectory guide 48 can be utilized to detect such exit velocity. Further, in one or more embodiments, such feedback can further include whether a ball flight would be placed within a particular ballpark or field. For example, in one or more embodiments, the feedback from the swing trajectory guide 48 can indicate to the batter that a particular swing would result in a home run in Fenway Park and where the ball would clear the fence in such park.

Figure 9:
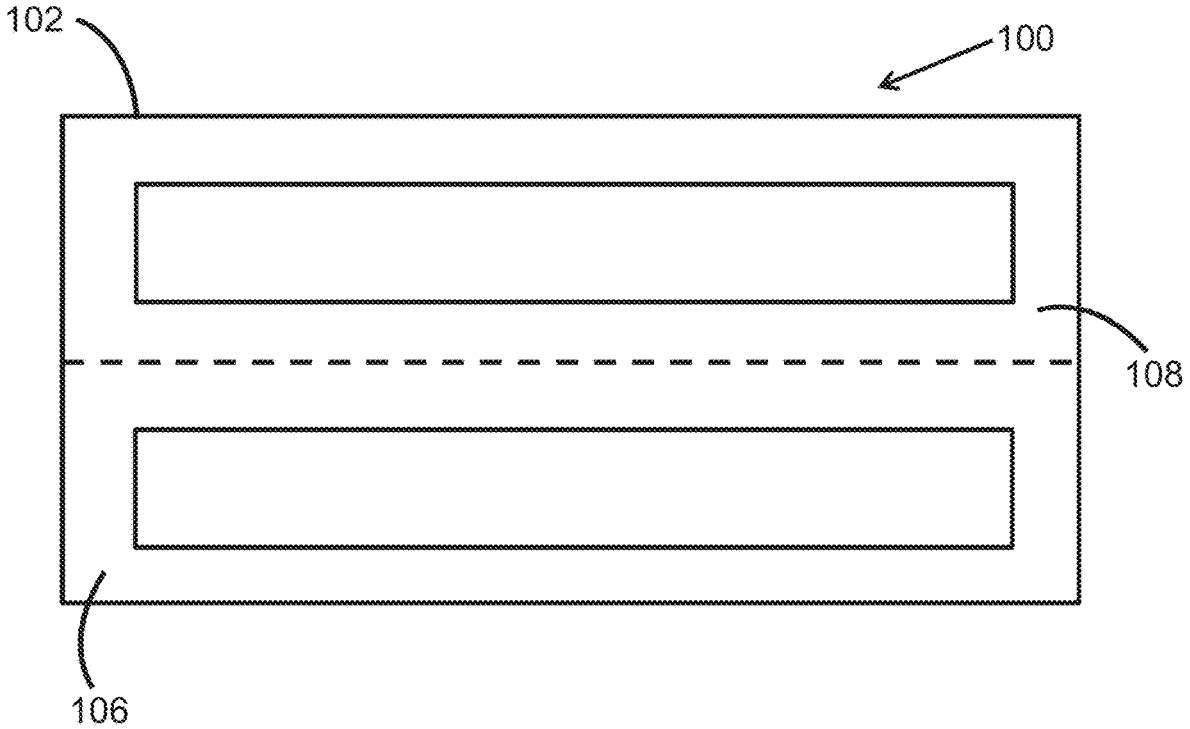
FIG. 9 is a schematic view of a swing training apparatus system that includes the swing training apparatus of FIG. 1.

The swing training apparatus 10 can be utilized with any suitable system. For example, FIG. 9 is a schematic view of one embodiment of a swing training apparatus system 100. The system 100 includes the swing training apparatus 10 of FIGS. 1-8 and a container 102 adapted to receive the swing training apparatus. Although described in regard to the swing training apparatus 10 of FIGS. 1-8, the system 100 can include any suitable swing training apparatus, e.g., swing training apparatus 210 of FIG. 10. The container 102 can include any suitable container such as a bag or case that is adapted to store the apparatus 10. In one or more embodiments, the container 102 includes a first compartment 106 and a second compartment 108. Although depicted as including two compartments, the container 102 can include any suitable number of compartments, e.g., one, two, three, four, five, or more compartments and the compartments could be positionally located in a horizontal or vertical direction or both directions in the container. Each compartment is adapted to receive a portion of the swing training apparatus 10. Further, the system 100 can include one or more accessories or replacement parts 104 for the apparatus. In one or more embodiments, the accessories can include additional bat contact indicators 44 of the casting indicator assembly 34.

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A swing training apparatus comprising:

an adjustable base assembly comprising a first major surface adapted to be disposed on a ground surface, a second major surface opposed to the first major surface, and a base axis that is substantially orthogonal to the first major surface, wherein the adjustable base assembly further comprises an adaptor adapted to connect the adjustable base assembly to a support and a rotating carrier connected to the support, wherein the rotating carrier is adapted to rotate relative to the adjustable base assembly about a central axis passing through the adaptor and support, wherein the central axis is substantially parallel to the base axis;

a ball arm assembly connected to the support and comprising a ball arm and a ball cradle, the ball arm extending along a ball arm axis between a base end of the ball arm and a cradle end of the ball arm, wherein the base end is connected to the support and the cradle end is distal from the support, and further wherein the ball cradle is connected to the ball arm at the cradle end of the ball arm; and a casting indicator assembly connected to the rotating carrier, the casting indicator assembly comprising:

a casting arm that extends between a first end and a second end along a casting arm axis, the first end located proximate the rotating carrier and the second end distal from the rotating carrier; and a casting indicator connected to the casting arm proximate the second end of the casting arm, the casting indicator extending away from the casting arm along a casting indicator axis, wherein the casting indicator comprises bat contact indicators extending away from an indicator base, and further wherein the indicator base is aligned with the casting indicator axis;

wherein rotation of the rotating carrier relative to the adjustable base assembly causes corresponding rotation of the casting indicator assembly.

2. The apparatus of claim 1, further comprising a swing trajectory guide rotatably connected to the ball arm such that the swing trajectory guide is adapted to rotate about the ball arm axis, wherein the swing trajectory guide extends between a rear end and a forward end along a guide axis.

3. The apparatus of claim 2, wherein the swing trajectory guide is further adapted to rotate about an attack angle axis that is substantially orthogonal to the ball arm axis such that an attack angle formed between the guide axis and a horizontal plane that is substantially parallel to the ground surface can be selected.

4. The apparatus of claim 1, wherein the adaptor is connected to a rotating plate that is rotatably connected to the adjustable base assembly such that the support, the ball arm assembly, the rotating carrier, and the casting indicator assembly are adapted to rotate relative to the adjustable base assembly about the base axis.

5. The apparatus of claim 4, wherein the adaptor is slidably connected to the rotating plate which is rotatably connected to the adjustable base assembly such that a distance between the base axis and the central axis measured in a direction orthogonal to the base and central axes is adjustable.

6. The apparatus of claim 1, wherein the adjustable base assembly further comprises:

a base plate comprising a first major surface and a second major surface, wherein the first major surface of the base plate defines the first major surface of the adjustable base assembly; and a rotating plate rotatably connected to the base plate and adapted to rotate about the base axis relative to the base plate, wherein the rotating plate comprises a first major surface that faces the second major surface of the base plate and a second major surface that defines the second major surface of the adjustable base assembly, wherein the adaptor is slidably connected to the rotating plate.

7. The apparatus of claim 1, wherein the casting assembly further comprises a counterweight disposed at the first end of the casting arm.

8. The apparatus of claim 1, further comprising a ball arm receiver connected to the support and adapted to slidably receive the base end of the ball arm.

9. The apparatus of claim 1, wherein the casting arm of the casting indicator assembly is slidably connected to the rotating carrier such that a distance between the casting indicator axis and the central axis as measured in a direction orthogonal to the casting indicator axis and the central axis is adjustable.

10. The apparatus of claim 1, wherein the rotating carrier further comprises a detent mechanism adapted to releasably fix the rotating carrier in a detent position relative to the casting arm.

11. The apparatus of claim 1, wherein the bat contact indicators comprise flexible members each extending from the indicator base.

12. A swing training apparatus system comprising a swing training apparatus and a container adapted to receive the swing training apparatus, the swing training apparatus comprising:

an adjustable base assembly comprising a first major surface adapted to be disposed on a ground surface, a second major surface opposed to the first major surface, and a base axis that is substantially orthogonal to the first major surface, wherein the adjustable base assembly further comprises an adaptor adapted to connect the adjustable base assembly to a support and a rotating carrier connected to the support, wherein the rotating carrier is adapted to rotate relative to the adjustable base assembly about a central axis passing through the adaptor and support, wherein the central axis is substantially parallel to the base axis;

a ball arm assembly connected to the support and comprising a ball arm and a ball cradle, the ball arm extending along a ball arm axis between a base end of the ball arm and a cradle end of the ball arm, wherein the base end is connected to the support and the cradle end is distal from the support, and further wherein the ball cradle is connected to the ball arm at the cradle end of the ball arm; and a casting indicator assembly connected to the rotating carrier, the casting indicator assembly comprising:

a casting arm that extends between a first end and a second end along a casting arm axis, the first end located proximate the rotating carrier and the second end distal from the rotating carrier; and a casting indicator connected to the casting arm proximate the second end of the casting arm, the casting indicator extending away from the casting arm along a casting indicator axis, wherein the casting indicator comprises bat contact indicators extending away from an indicator base, and further wherein the indicator base is aligned with the casting indicator axis;

wherein rotation of the rotating carrier relative to the adjustable base assembly causes corresponding rotation of the casting indicator assembly.

13. The system of claim 12, wherein the container comprises at least two compartments each adapted to receive a portion of the swing training apparatus.

14. The system of claim 12, wherein the bat contact indicators comprise a plurality of flexible members that are removably connected to the indicator base, wherein the system further comprises at least one replacement flexible member.

15. The system of claim 12, further comprising a swing trajectory guide rotatably connected to the ball arm such that the swing trajectory guide is adapted to rotate about the ball arm axis, wherein the swing trajectory guide extends between a rear end and a forward end along a guide axis.

16. The system of claim 15, wherein the swing trajectory guide is further adapted to rotate about an attack angle axis that is substantially orthogonal to the ball arm axis such that an attack angle formed between the guide axis and a horizontal plane that is substantially parallel to the ground surface can be adjusted.

17. The system of claim 12, wherein the casting indicator assembly is removably connected to the rotating carrier.

18. The system of claim 12, wherein the support is removably connected to the adaptor.

19. The system of claim 12, wherein the indicator base is removably connected to the casting arm.

20. A swing training apparatus system comprising an assembly method step comprising:

connecting an adaptor slidably to a rotating plate that is rotatably connected to an adjustable base assembly, wherein the adjustable base assembly comprises a first major surface adapted to be disposed on a ground surface, a second major surface opposed to the first major surface, and a base axis that is substantially orthogonal to the first major surface;

connecting a support to the adaptor;

connecting a rotating carrier to the support, wherein the rotating carrier is adapted to rotate relative to the adjustable base assembly about a central axis passing through the adaptor and support, wherein the central axis is substantially parallel to the base axis;

connecting a casting indicator assembly to the rotating carrier, wherein the casting indicator assembly comprises a casting arm and a casting indicator connected to the casting arm; and connecting a ball arm assembly to the support, the ball arm assembly comprising a ball arm and a ball cradle connected to the ball arm, the ball arm extending along a ball arm axis between a base end of the ball arm and a cradle end of the ball arm, wherein the base end is connected to the support and the cradle end is distal from the support, and further wherein the ball cradle is connected to the ball arm at the cradle end of the ball arm.

* * * * *